US005085348A

United States Patent [19]

Huerlimann et al.

[11] Patent Number: 5,085,348

[45] Date of Patent: Feb. 4, 1992

[54] RECLOSABLE CONTAINER HAVING A POURING SPOUT

[75] Inventors: Peter Huerlimann, Konolfingen; Eugene Van Meir, Fribourg, both of Switzerland

[73] Assignee: Nestec S.A., Vevey, Switzerland

[21] Appl. No.: 607,596

[22] Filed: Oct. 31, 1990

Related U.S. Application Data

[63] Continuation of Ser. No. 321,644, Mar. 8, 1989, abandoned.

[30] Foreign Application Priority Data

Mar. 17, 1988 [EP] European Pat. Off. ..... 88104221

[51] Int. Cl.[5] ..... B67D 5/32

[52] U.S. Cl. ..... 222/153; 222/541

[58] Field of Search ..... 222/153, 541, 542, 556, 222/545, 482, 480

[56] References Cited

U.S. PATENT DOCUMENTS

| | | | |
|---|---|---|---|
| 3,084,835 | 4/1963 | Walsh | 222/541 |
| 3,101,870 | 8/1963 | Betner | 222/153 |
| 3,977,578 | 8/1976 | Perry | 222/541 |
| 4,091,957 | 5/1978 | Moller | 222/541 |
| 4,545,508 | 10/1985 | Cribb, Jr. et al. | 222/153 |

*Primary Examiner*—H. Grant Skaggs
*Assistant Examiner*—Kenneth Noland
*Attorney, Agent, or Firm*—Vogt & O'Donnell

[57] ABSTRACT

A reclosable container has a base and has a sidewall defining a substantially cylindrical or frustoconical shaped container portion and defining a pouring spout. The sidewall extends from the base to a container upper rim portion merged integrally with a V shaped pouring spout rim portion and with an upper rim tab which extends about and away from the pouring spout rim and which is separated from an outer edge of the pouring spout rim by a V shaped cut out slit which follows the contour of the pouring spout rim. A lid is welded to the container portion rim, the pouring spout rim and the rim tab for covering the container. A holding portion is integral with the sidewall.

11 Claims, 3 Drawing Sheets

RECLOSABLE CONTAINER HAVING A POURING SPOUT

CROSS REFERENCE TO RELATED APPLICATION

This is a continuing application of application Ser. No. 07/321,644, filed Mar. 8, 1989, now abandoned.

BACKGROUND OF THE INVENTION

This invention relates to a recloseable container of synthetic material comprising a pull-open lid, more particularly for condensed milk or coffee "creamer".

EP 137 997 already describes a container of this type comprising a holding portion and a pouring opening. This type of container is designed to be emptied in several stages. The disadvantage of this type of pack is that it does not have a reclosable system which means that, when the pack is used for second time, a crust of milk is formed around the pouring opening which, on the one hand, is unsightly and, on the other hand, may place the milk in danger of contamination.

U.S. Pat. No. 3,101,870 relates to a recloseable container comprising a rim welded to a lid, the rim having to be torn by means of weakening grooves when the container is opened for the first time. DE-OS 34 46 093 relates to a container based on the same principle as the container just mentioned, in which the opening tab has to be torn when the container is used for the first time. This type of opening requires a considerable opening force which may lead the user into mishandling the container and upsetting its contents.

The present invention enables this type of drawback to be overcome by virtue of a system which enables the container to be reclosed as and when required and in which the opening tab is almost completely cut out in advance.

SUMMARY OF THE INVENTION

The present invention relates to a recloseable container of synthetic material with a pull-open lid, particularly for condensed milk or coffee creamer, comprising a base, a side wall and an upper rim for filling and for opening the pull-open lid, the sidewall defining a container portion substantially cylindrical or frustoconical in shape and comprising a holding portion and a pouring spout on the side wall having a V shaped upper rim merged integrally with the container portion upper rim. It comprises an opening rim tab which is merged integrally with the container portion upper rim and extends away from the pouring spout rim and is separated from the pouring spout rim edge by a V cut slit adjacent the upper rim to follow the contour of the pouring spout rim and which is designed to be placed in position to open and close the container, and the lid is welded to the upper rim along its entire periphery, particularly in the zone of the pouring spout, on either side of the contour of the edge thereof. Since the opening tab is completely cut out from the upper rim, except at the end of the sides of the V where the pouring spout rim and rim tab merge about the cut out slit which thereby defines an opening between the rim tab and an outer edge of the pouring spout rim, the lid has to be welded to the opening tab and to the interior of the rim of the pouring spout to establish a seal before opening.

This type of pack may be used not only for condensed milk, but also for milk, cream, sauces, toppings and other liquid food products. It is very convenient to use because, when the contianer is used for the first time, the opening tab merely has to be pulled to detach the lid from the upper rim inside the part around the pouring spout although the lid remains welded to the opening tab and to the rest of the periphery of the container. After use, the tab is pressed down onto the pouring spout.

DESCRIPTION OF PREFERRED EMBODIMENTS

To provide the opening tab with high rigidity, a reinforcing zone is provided beneath it in the zone of the pouring spout, extending for about 5 to 40 mm along the edge of the pouring spout. This reinforcement is preferably of U-shaped cross-section and, in addition, enables a seal to be better established when the container is reclosed.

The container minus lid is made either by thermoforming or by injection moulding. The opening tab is an integral part of the upper rim, simply being cut along the contour of the pouring spout.

The cut is preferably made obliquely to facilitate engagement during closure of the tab which ensures effective sealing.

As mentioned above, the opening tab is not cut to the end of the sides of the V. At this point, the tab is advantageously notched beneath the rim and towards the outside thereof adjacent the merger of the rim tab and the pouring spout rim edge to allow a good hinge effect during opening so that the container remains properly open in use.

In another embodiment, the lid comprises a zone where it is not welded to the opening lid between the welded zones on either side of the contour of the edge of the pouring spout.

To obtain a thin jet of milk during pouring, the walls of the pouring spout form and angle of from 60° to 95° and preferably an angle of approximately 92°.

The material used for the body of the container is selected from polypropylene, polyethylene, polyester, polyamide, polycarbonate and polyvinyl chloride in cases where the container and its contents are heat-treated, for example by post-sterilization. The container is either single-layer or multi-layer, in which case the polypropylene/EVOH/polypropylene combination may be considered. Instead of the EVOH (ethylene/vinyl alcohol copolymer) layer, any other layer forming an oxygen barrier, for example polyvinylidene chloride, may be considered. If the container is filled aseptically, the range of plastics may be extended to polystyrenes and copolymers thereof.

The pull-open lid is normally an aluminium foil sealed to the upper rim of the container by welding. Other lids, for example of plastics materials, such a polyvinyl chloride, may also be condidered. To avoid cracking of the lid in the event of post-sterilization, a chequered lid is selected.

The invention is described in more detail with reference to the drawings.

DETAILED DESCRIPTION OF THE DRAWINGS

Figure 3:
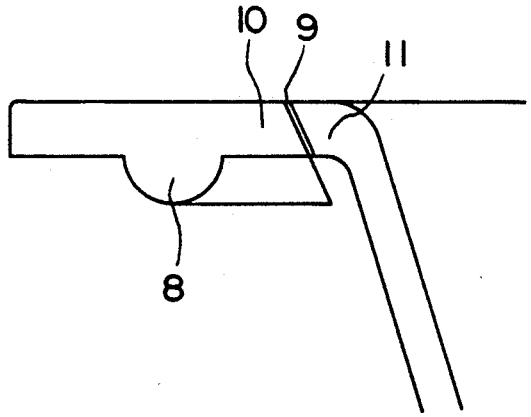
FIG. 3 is a section on the line B—B of FIG. 2.

The container comprises a base (1), a side wall (2) and an upper rim (3). On the side wall are the pouring spout (4) and the holding portion (5). The pull-open lid (6) is welded to the rim (3) which comprises an opening tab (7) in the region of the pouring spout. The tab (7) comprises a reinforcing zone (8) of substantially U-shaped cross-section and a slit is cut from the upper rim along the line (9) defining the contour of the edge of the pouring spout. The cut is normally oblique, as shown in FIG. 3.

Figure 1:
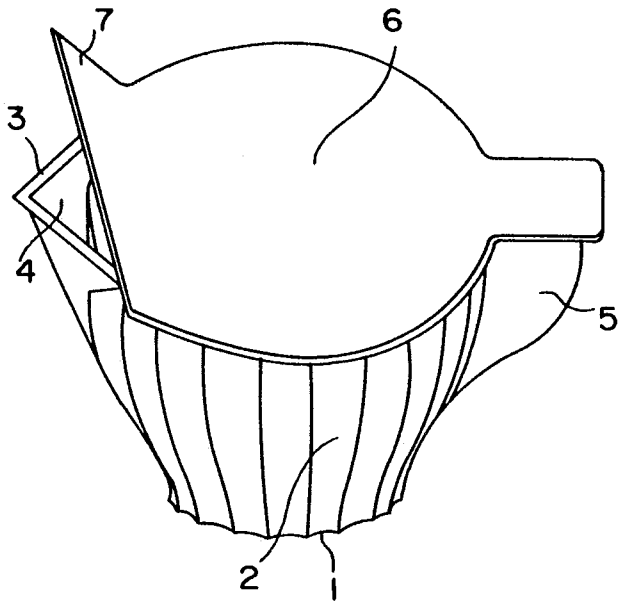
FIG. 1 is a perspective view of the container according to the invention with the pull-open lid open.
Figure 6:
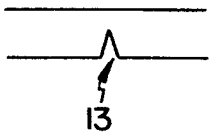
FIG. 6 shows the notch beneath the rim.
Figure 4:
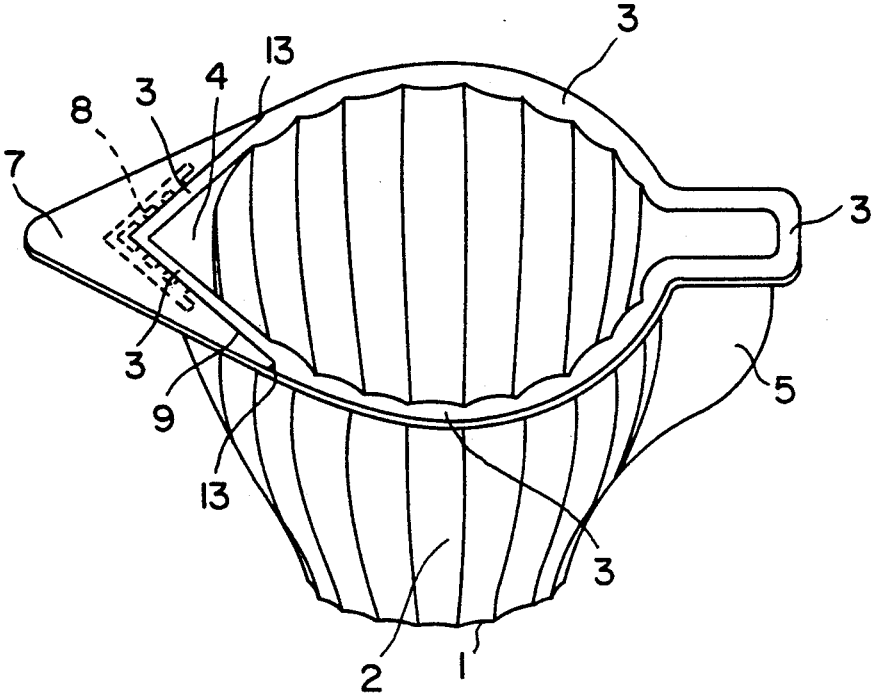
FIG. 4 is a perspective view of the container according to the invention without the pull-open lid.

The container is made as described in the following. Thermoforming gives the shape shown in FIG. 4. The cut is made along the line (9). In the case of aseptically filling, the container is sterilized and taken to an aseptic filling machine where it is filled, for example with condensed milk. Finally, the pull-open lid (6) is welded to the upper rim (3). The lid must be welded to the zone (a) of pouring spout rim (3) (FIG. 2) and to the opening tab (7). The zone (a) must be at least 1 mm wide to guarantee effective sealing of the container. A container filled with a long-life product ready for consumption is thus obtained.

Figure 2:
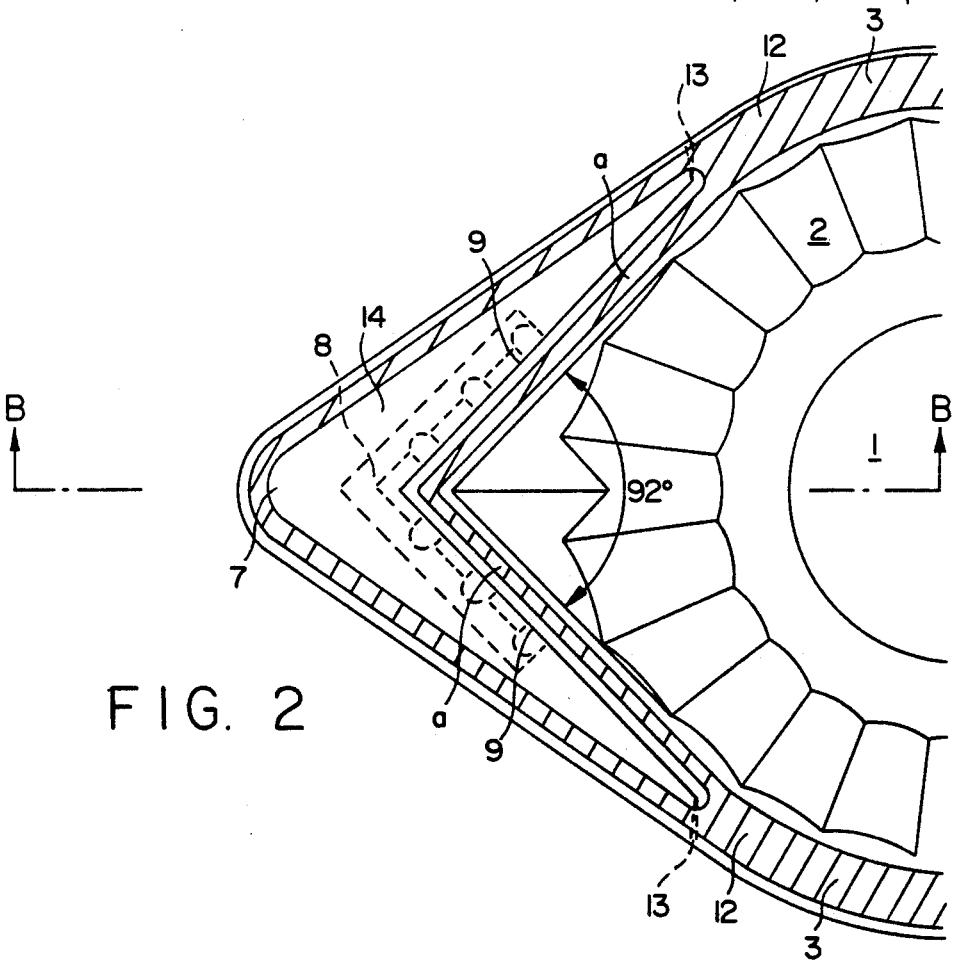
FIG. 2 is a view from above of the upper rim minus lid.

Thus, the container comprises a base (1), a sidewall (2) extending from the base defining a container portion, which has a shape which is substantially cylindrical or substantially frustoconical, and defining a pouring spout (4) and extending to an upper rim (3) comprised of a container rim portion merged integrally wiht a V shaped pouring spout rim portion (zone (a) FIG. 2) and with a rim tab (7) which extends about and away from the pouring spout rim and which is separated from the pouring spout rim by a V shaped cut out slit which follows the contour of the pouring spout rim and which thereby defines an opening between the rim tab and an outer edge (11) of the pouring spout rim, and a lid (6) welded to the container portion rim, the pouring spout rim and the rim tab for covering the container, and a holding portion (5) integral with the sidewall.

In the case of filling with post-sterilization, the container with its contents is transferred to a sterilizing unit. The welding of the lid to the upper rim (3) (FIG. 4) has to be of very high quality to withstand the sterilization conditions. Thus, the width of the weld bead must be of the order of 2 mm. In the region of the pouring spout, the welding width is approximately 2 mm on either side of the line (9).

Figure 5:
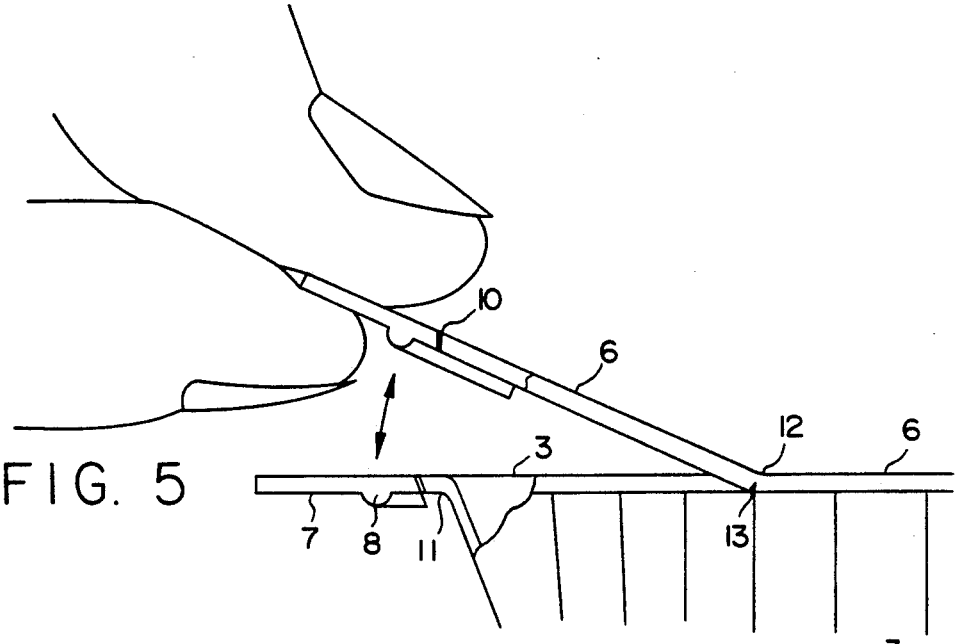
FIG. 5 is a section on the line B—B of FIG. 2 with the lid, the container being in the open and closed position.

In using the filled container, the opening tab (7) is pulled upwards and rearwards (FIG. 5). The lid (6) remains integral with the tab, but is detached from the upper rim (3) in the zone (a). The tab is raised high enough to form a good outlet opening for milk or any other product.

After use, the tab (7) is pressed down frontwards. It engages through its edge (10) with the outer edge (11) of the pouring spout. The angle forming the pouring spout is approximately 92°.

The exact positioning of the edge (10) in relation to the edge (11) is obtained by the hinge function of the uncut part (12) (FIG. 5) of the rim (3). At this point, a notch (13) is advantageously provided beneath the upper rim (3) and towards the outside thereof adjacent the merger of the rim tab and the pouring spout rim edge to ensure proper opening of the container in use for pouring its contents. The zone where the lid is welded to the upper rim is indicated by the hatching in FIG. 2.

The opening tab (7) has a zone (14) where it is not welded to the lid. By contrast, in the zone (12), the ribbon of welding has to be wide enough to ensure firm adhesion of the lid at the point which acts as a hinge for the successive opening and closing of the container.

The cream container according to the invention is normally designed to hold 120 to 200 ml.

The invention thus provides a tightly recloseable container which is easy to use and can be made and packed on conventional filling lines.

We claim:

1. A reclosable container comprising:

a base;

a sidewall extending from the base defining a container portion which has a shape selected from the group of shapes consisting of a substantially cylindrical shape and a substantially frustoconical shape and defining a pouring spout and extending to an upper rim comprised of a container rim portion merged integrally with a V shaped pouring spout rim portion and with a rim tab which extends about and away from the pouring spout rim and which is separated from the pouring spout rim by a V shaped cut out slit which follows the contour of the pouring spout rim and which thereby defines an opening between the rim tab and an outer edge of the pouring spout rim;

a lid welded to the container portion upper rim, the pouring spout rim and the rim tab for covering the container; and a holding portion integral with the sidewall.

2. A container according to claim 1 wherein the slit space defines an oblique angle between the pouring spout rim edge and the rim tab.

3. A container according to claim 1 further comprising a reinforcing member on an underside of the rim tab adjacent the slit.

4. A container according to claim 3 wherein the reinforcing member has a U shaped cross section.

5. A container according to claim 4 wherein the reinforcing member extends for from 5 mm to 40 mm.

6. A container according to claim 1 or 3 further comprising a notch beneath and adjacent a merger of the rim tab, pouring spout rim portion and container portion rim towards the outside thereof for providing a hinge effect for the rim tab.

7. A container according to claim 1 or 3 wherein the pouring spout has walls which from an angle of from 60° to 95°.

8. A container according to claim 1 wherein the base and sidewall and rim are made of a material selected from the group consisting of polypropylene, polyethylene, polyester, polyamide, polycarbonate, polyvinyl chloride, a polypropylene/EVOH/polypropylene combination, a polypropylene/polyvinylidene chloride/-polypropylene combination and polystyrenes and copolymers thereof.

9. A container according to claim 1 wherein the lid is made of a material selected from the group consisting of aluminum foil and polyvinyl chloride.

10. A container according to claim 1 or 13 wherein the lid is welded to the pouring spout rim portion with a weld bead having a width of at least 1 mm.

11. A container according to claim 1 or 3 wherein the lid is checkered.

* * * * *

UNITED STATES PATENT AND TRADEMARK OFFICE

CERTIFICATE OF CORRECTION

PATENT NO. : 5,085,348

DATED : February 4, 1992

INVENTOR(S) : Peter HUERLIMANN, et al.

It is certified that error appears in the above-identified patent and that said Letters Patent is hereby corrected as shown below:

Column 1, line 12, delete "more".

Column 1, line 52, delete "edge".

Column 1, line 52, after "cut" insert --out--.

Column 3, line 21, begin a new paragraph with the sentence "In the case of aseptically....".

Column 3, line 36, "wiht", should be --with--.

Column 4, line 63 (line 1 of claim 10), "13" should be --3--.

Signed and Sealed this

Thirteenth Day of April, 1993

*Attest:*

*Attesting Officer*

STEPHEN G. KUNIN

*Acting Commissioner of Patents and Trademarks*